US005913459A

United States Patent [19]

Gill et al.

[11] Patent Number: 5,913,459

[45] Date of Patent: Jun. 22, 1999

[54] HIGH FLOW HOPPER, CHARGING ADAPTER AND ASSEMBLY OF SAME

[75] Inventors: David R. Gill, Stewartsville, N.J.; John Simonof, Easton; Keith Sterner, Bath, both of Pa.

[73] Assignee: Flexicon Corporation, Phillipsburg, N.J.

[21] Appl. No.: 08/884,175

[22] Filed: Jun. 27, 1997

Related U.S. Application Data

[60] Provisional application No. 60/045,669, May 6, 1997.

[51] Int. Cl.[6] ..... B65D 88/26; B65D 5/72; B67D 5/60; B67D 5/06

[52] U.S. Cl. ..... 222/460; 222/144; 222/185.1; 222/462; 222/575

[58] Field of Search ..... 222/185.1, 144, 222/460, 462, 575

[56] References Cited

U.S. PATENT DOCUMENTS

| | | | |
|---|---|---|---|
| 360,608 | 4/1887 | McKinnon | 222/144 |
| 1,059,781 | 4/1913 | Stephen | 222/144 |
| 3,797,707 | 3/1974 | Jenike et al. | 222/193 |
| 4,286,883 | 9/1981 | Johanson | 366/137 |
| 4,646,910 | 3/1987 | Johanson et al. | 198/535 |
| 4,757,757 | 7/1988 | Johanson | 100/41 |
| 4,867,343 | 9/1989 | Ricciardi et al. | 222/1 |
| 4,958,741 | 9/1990 | Johanson | 220/83 |
| 4,986,456 | 1/1991 | Johanson | 222/561 |
| 5,013,530 | 5/1991 | McGregor | 222/460 |
| 5,139,173 | 8/1992 | Evinger | 222/185.1 |
| 5,160,016 | 11/1992 | Moksnes | 198/533 |
| 5,301,844 | 4/1994 | Ricciardi | 222/199 |
| 5,423,455 | 6/1995 | Ricciardi et al. | 222/1 |
| 5,445,289 | 8/1995 | Owen | 222/185.1 |
| 5,462,351 | 10/1995 | Royal | 366/101 |
| 5,673,823 | 10/1997 | Hanks et al. | 222/185.1 |
| 5,758,804 | 6/1998 | Wirth | 222/460 |

*Primary Examiner*—Andres Kashnikow
*Assistant Examiner*—Keats Quinalty
*Attorney, Agent, or Firm*—Volpe and Koenig, P.C.

[57] ABSTRACT

A hopper assembly comprising a hopper bin having a substantially trapezoidal discharge opening and a charging adapter having multiple walls, each of the walls having a vertical portion.

18 Claims, 2 Drawing Sheets

FIG. 8
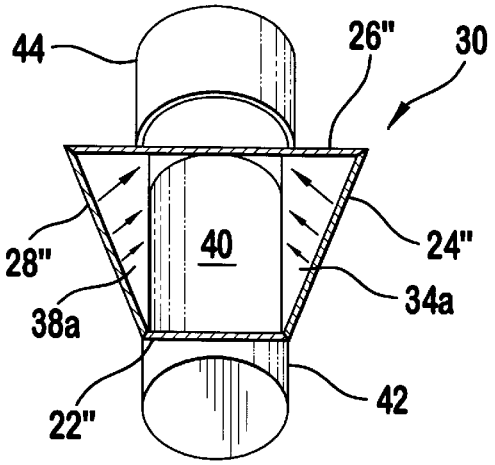
FIG. 9
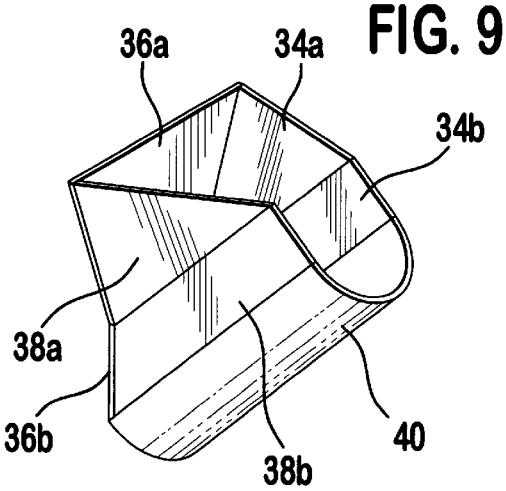
FIG. 10
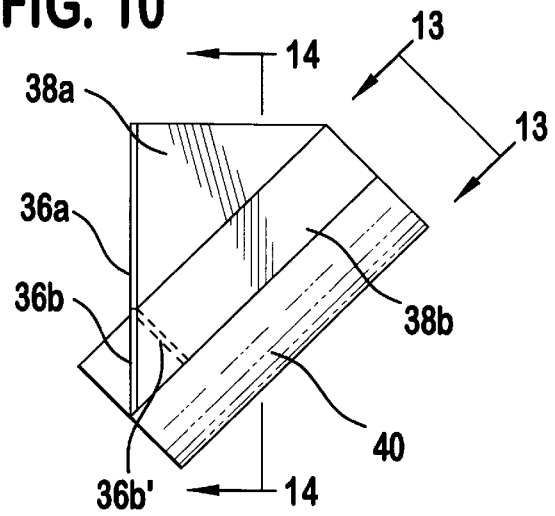
FIG. 11
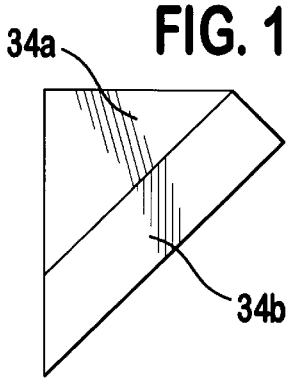
FIG. 12
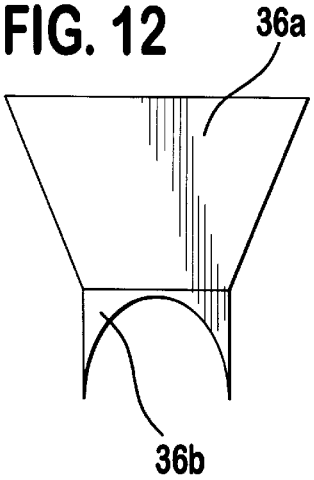
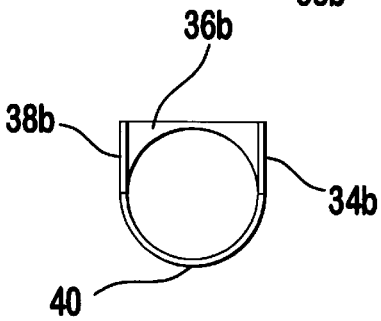
FIG. 13
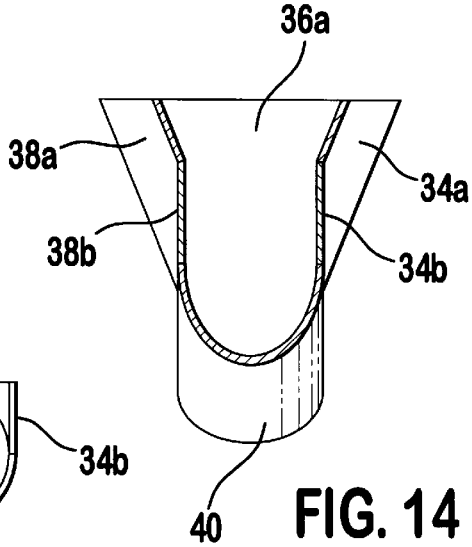
FIG. 14

HIGH FLOW HOPPER, CHARGING ADAPTER AND ASSEMBLY OF SAME

This application claims the benefit of U.S. Provisional Application No. 60/045,669, filed May 6, 1997.

BACKGROUND OF THE INVENTION

1. Field of the Invention

The present invention generally relates to an apparatus used in the conveying of particulate materials. More particularly, the invention relates to hopper bins and charging adapters used in the conveying of particulate materials.

2. Description of the Prior Art

In the process of conveying particulate materials, it is often beneficial to utilize a hopper assembly. The hopper assembly may be used in conjunction with other machinery, for example, bulk bag dischargers, mixing bins, or conveyors. The hopper assemblies often comprise a hopper bin and a charging adapter. Such hopper bins are generally cone-shaped, extending upwardly from a discharge opening outwardly towards a larger receiving opening. The charging adapters generally act as the transition between the output of material and a conveying means.

Generally, particulate materials do not flow freely when the angle at which the material is flowing is less than the material's angle of repose. As a result of the general configuration of prior hopper bins and charging adapters, a stable arch, bridge, or "rat hole" develops within the material and flow ceases. Even if flow does not completely cease, other problems such as erratic flow, flushing, segregation, and degradation of the material occur. These problems are enhanced when the surfaces between which the material is flowing are diametrically opposed.

In attempts to overcome these difficulties, prior art hoppers have been designed with larger discharge openings and steep hopper walls which are intended to be steeper then the angle of repose. However, increasing the size of the discharge opening provides less control over the material flow. Also, when the opening is larger than the conveyor which is being used, the conveyor does not move all of the material which exits the opening, and the non-moving material generally acts as a platform which prevents the flow of material above it. With respect to increasing the hopper wall angle, the angle of repose for some materials approaches ninety degrees and therefore a hopper which can be utilized with any such material would need substantially vertical walls. This causes the hoppers to take up more space and have a higher receiving opening plane, thereby making it more difficult to directly load the hopper bin.

In the present invention, the hopper assembly includes a hopper bin having a substantially trapezoidal discharge opening and a charging adapter which has sheer planes that cause the bulk material to "break" and flow before arching or bridging occurs.

SUMMARY OF THE INVENTION

The present invention provides a hopper assembly which generally comprises a hopper bin having a substantially trapezoidal discharge opening and a charging adapter aligned therewith. The charging adapter has multiple walls, each of which has a vertical portion that acts as a sheer plane to "break" the particulate material before arching or bridging occurs. The walls of the charging adapter meet at a trough to which a conveyor may be interconnected.

BRIEF DESCRIPTION OF THE DRAWINGS

FIG. 8 is a section taken along the line 8—8 in FIG. 2.

FIG. 9 is an isometric view of the charging adapter without the nose piece and end cap.

FIG. 10 is a side elevation view of the charging adapter without the nose piece and end cap.

FIG. 11 is a front elevation view of one of the walls of the charging adapter.

FIG. 12 is a front elevation view of a second wall of the charging adapter.

FIG. 13 is an elevation view of a portion of the charging adapter along the line 13—13 in FIG. 10.

FIG. 14 is a section view taken along the line 14—14 in FIG. 10.

DESCRIPTION OF THE PREFERRED EMBODIMENT

The preferred embodiment will be described with reference to drawings figures wherein like numerals represent like elements throughout.

Figure 1:
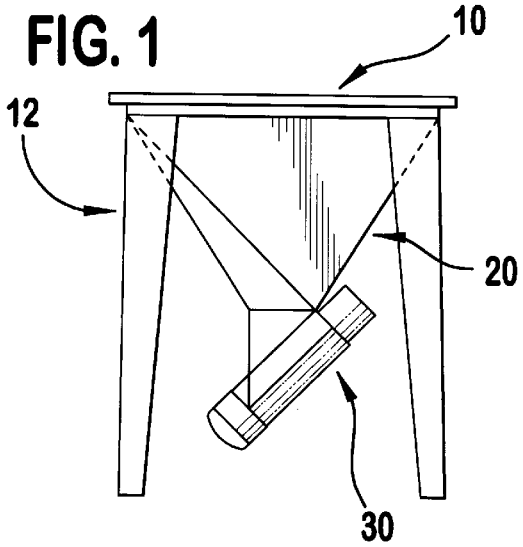
FIG. 1 is a side elevation view of the hopper assembly according to the present invention.
Figure 2:
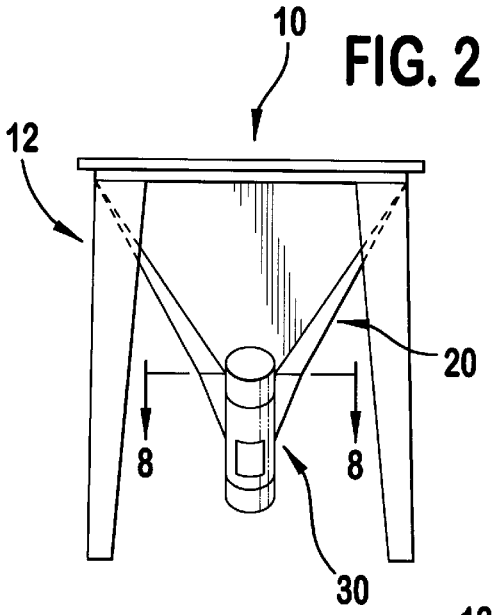
FIG. 2 is an elevation view of a second side of the hopper assembly.
Figure 3:
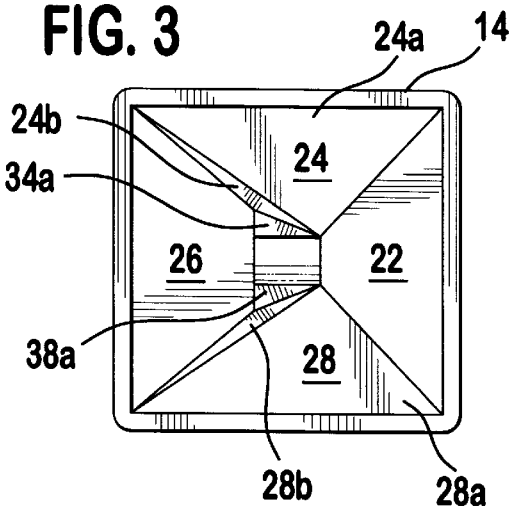
FIG. 3 is a top plan view of the hopper assembly.
Figure 4:
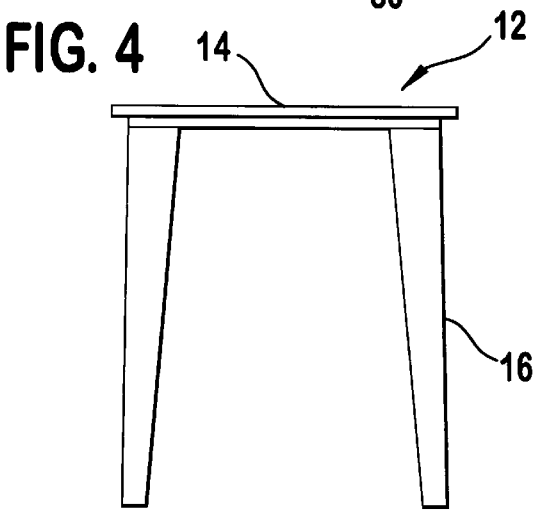
FIG. 4 is a side elevation of the frame.

FIGS. 1–3 show the hopper assembly 10 according to the present invention. The hopper assembly 10 generally comprises a frame 12, a hopper bin 20 and a charging adapter 30. As shown in FIG. 4, the frame 12 comprises support members 14 and legs 16. The support members 14 are generally configured to support the hopper bin 20 and to fix the end use application, as will be known to those skilled in the art. In the preferred embodiment, the support members 14 lie in a horizontal plane. The hopper bin 20 may be fixed to the support members 14, or alternatively, the hopper bin 20 may be releasably mounted on the support members 14.

In the preferred embodiment as shown in FIG. 3, the hopper bin 20 comprises four walls, 22–28, preferably made of sheet metal. For clarity purposes only, the walls 22, 24, 26 and 28 shall be referred to as the front, left, rear and right wall respectively. Each hopper wall 22–28 is generally trapezoidal and is inclined at an acute angle, relative to a horizontal plane. Preferably, the angle of incline of the walls 22–28 is approximately 60°. The hopper bin 20 tapers from a large, upper receiving opening to a smaller, substantially trapezoidal lower discharge opening, as shown in FIGS. 1–3. The discharge opening is preferably trapezoidal in shape and oriented in a horizontal plane spaced from and parallel to the plane of the frame support members. However, in some applications, it may be desirable to tilt the orientation of the opening from the horizontal plane or configure the walls such that the opening is not a regular trapezoid.

Figure 5:
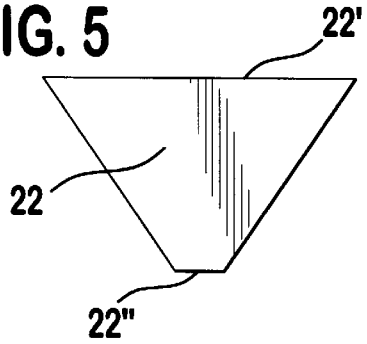
FIG. 5 is an elevation of a first hopper wall.

As shown in FIG. 5, the front wall 22 is generally trapezoidal, tapering from an upper edge 22' to a lower edge 22".

Figure 6:
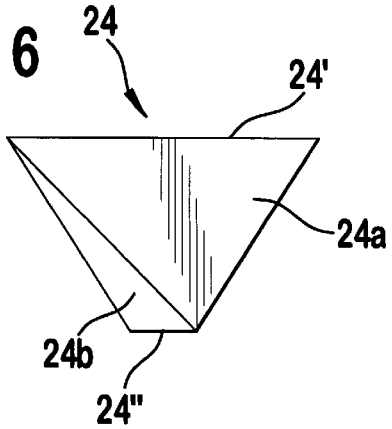
FIG. 6 is an elevation of a second hopper wall.

The left and right walls 24, 28 are mirror images of each other. The left wall 24 is shown in FIG. 6 and preferably comprises two portions 24*a* and 24*b*. In the preferred embodiment, the first portion 24*a* is oriented in a plane inclined at an angle relative to the horizontal which is similar to the other walls 22,26,28. The second portion 24*b* extends along a plane which is steeper than the plane of the first portion 24*a* whereby the second portion 24*b* extends downward and rearward from the first portion 24*a*, as can be seen in FIG. 3. The rearward, steeper incline of the second portions of the side walls 24*b*, 28*b* allow the lower edges of the side walls 24", 28" to define the edges of the substantially trapezoidal discharge opening as shown in FIG. 8. In a preferred method of manufacture, the first and second portions 24*a* and 24*b* are formed as a single trapezoid panel on which a portion is bent out of the panel's plane, along the bend axis, to form the distinct portions 24*a* and 24*b*.

Figure 7:
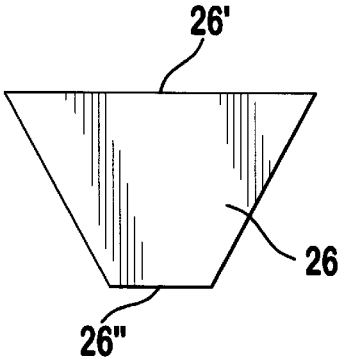
FIG. 7 is an elevation of a third hopper wall.

The rear hopper bin wall 26, shown in FIG. 7, is trapezoidal in shape. The side edges of the rear wall 26 are tapered less than the side edges of the front wall 22, whereby the lower edge 26" of the rear wall 26 is wider than the corresponding edge 22" of the front wall 22. The slighter taper of the rear wall 26 allows it to be oriented in a plane with an approximately equivalent angle of incline with respect to horizontal as the other walls 22, 24, 28, while still meeting the steeper, second portions 24*b* and 28*b* of the side walls 24 and 28, as shown in FIG. 3. The lower edges of the walls 22"–28" define the substantially trapezoidal discharge opening.

As shown in FIGS. 8–14, the charging adapter 30 generally comprises three walls 34–38, a trough 40, a nose piece 42 and an end cap 44. The upper edge of the adapter 30 is generally configured to match the discharge opening of the hopper bin 20, both in orientation and shape. For clarity purposes only, the adapter walls 34, 36, 38 will be referred to as left, rear and right wall respectively.

The left and right adapter walls 34 and 38 are preferably mirror images of one another. The left adapter wall 34, as shown in FIG. 11, comprises a first portion 34*a* and a second portion 34*b*. The first portion 34*a* is generally triangular and, when positioned relative to the hopper bin 20, is oriented in a plane which is inclined from the plane of the discharge opening whereby the first portion 34*a* is inclined inwardly from the lower edge of the left hopper wall 24". The first portions of the side adapter walls 34*a*, 38*a* thereby act to gradually taper the path of the material from the substantially trapezoidal discharge opening to a more rectangular opening in the charging adapter 30, as shown in FIG. 8. This provides a more controlled, steady flow of material.

Additionally, since each first portion 34*a* and 38*a* is angled from the wider rear edge 26" to the narrower edge 22", as shown in FIGS. 8 and 14, the first portions 34*a* and 38*a* are not diametrically opposed. To state it another way, particulate material flowing down each first portion 34*a* and 38*a* is directed toward the generally vertical rear wall 36, as shown by the arrows in FIG. 8, rather than directly toward the opposite wall, whereby the particles could meet and form a bridge.

The second portion of the left adapter wall 34*b* is generally rectangular and is oriented in a substantially vertical plane. In this vertical orientation, the second portions 34*b* and 38*b* act as sheer planes which cause the particulate material to "break", thereby providing another means for preventing arching or bridging.

The rear adapter wall 36, shown in FIG. 12, comprises first and second portions. The first portion 36*a* is trapezoidal and, when positioned relative to the hopper bin 20, depends from the rear hopper wall lower edge 26" in a plane that is generally vertical. The second portion 36*b* is generally rectangular with an arched cutout and preferably depends from the first portion 36*a* in the same substantially vertical plane. In this configuration, the rear adapter wall 36 forms a substantially vertical sheer plane at the lower edge of the rear hopper wall 26". It has also been found that the second portion 36*b* may be inclined slightly relative to the first portion, one example of which is shown in phantom as 36*b*' in FIG. 10, without affecting the flow. The second portion 36*b* is approximately the same width as the lower edge of the front hopper wall 22".

As shown in FIGS. 13 and 14, a trough 40 interconnects the lower edges of the side adapter walls 34 and 38. The trough is preferably semi-circular, whereby a generally tubular charging chute is formed. An end cap 44 is attached at one end of the charging chute and a nose piece 42 is attached at the other. The nose piece 42 is preferably interconnected with a flexible screw type conveyor (not shown), with the screw preferably extending completely through the tubular chute to the end cap 44.

The charging adapter 30 may be formed integral with the hopper bin 20 or may be formed as an independent component which is attached to the hopper bin 20 or used in conjunction with other components. When assembled, the substantially trapezoidal discharge opening provides a larger opening to promote flow, while the side walls 34,38 of the charging adapter 30 help to maintain controlled flow without utilizing diametrically opposed surfaces. The steeper portions of the hopper side walls 24*b*, 38*b* and portions of each of the charging adapter walls 34–38 act as sheer planes which cause the particulate material to "break" and flow to the tubular chute before arching or bridging occurs.

While the present invention has been described in terms of the preferred embodiments, other variations which are within the scope of the invention as set forth in the claims will be apparent to those skilled in the art.

We claim:

1. A charging adapter comprising:

a first wall having first and second ends, first and second edges, a first portion oriented in a first plane which is inclined at a first angle relative to a horizontal plane and a second portion which is substantially vertical relative to the horizontal plane;

a second wall having first and second ends, first and second edges, a first portion oriented in a second plane which is inclined at a second angle relative to the horizontal plane and a second portion which is substantially vertical relative to the horizontal plane;

a third wall which connects the first and second walls; and a trough which connects the second portions of the first and second walls whereby the first and second wall first edges are at a first predetermined separation at the first ends and a second, distinct predetermined separation at the second ends and the first and second wall second edges are at a third predetermined separation at the first ends and a fourth predetermined separation at the second ends.

2. The charging adapter of claim 1 wherein the second, third, and fourth separations are equal.

3. The charging adapter of claim 1 wherein the first and second wall first portions are generally triangular.

4. The charging adapter of claim 1 wherein the first and second wall second portions are generally rectangular.

5. The charging adapter of claim 1 wherein the third wall has a generally trapezoidal portion and a generally rectangular portion.

6. The charging adapter of claim 1 further including a generally trapezoidal receiving opening.

7. A charging adapter in accordance with claim 1 which is formed integral with a hopper bin.

8. The charging adapter of claim 1 wherein the first wall is a mirror image of the second wall.

9. A hopper having a receiving opening of a given perimeter and a discharge opening of a smaller perimeter located at a predetermined distance from the receiving opening, the hopper comprising:

a) a first wall including:

i. first and second edges, ii. a first portion oriented in a first plane, and iii. a second portion oriented in a second plane which forms a greater angle relative to a horizontal plane than the first plane;

b) a second wall including:

i. first and second edges, ii. a first portion oriented in a third plane, and iii. a second portion oriented in a fourth plane which forms a greater angle relative to the horizontal plane than the third plane;

c) a third wall oriented in a fifth plane and including first and second edges; and d) a fourth wall oriented in a sixth plane and including first and second edges, wherein the walls are connected such that the receiving opening perimeter includes the first edges of the walls, the discharge opening perimeter includes the second edges of the walls and the discharge opening is generally trapezoidal.

10. The hopper of claim 9 wherein the first, third, fifth and sixth planes are inclined at angles relative to the horizontal plane in the range of 55 to 70 degrees.

11. The hopper of claim 10 wherein the incline angles of the first, third, fifth and sixth planes are equal.

12. The hopper of claim 9 wherein the first wall is a mirror image of the second wall.

13. The hopper of claim 9 wherein the third and fourth walls are generally trapezoidal.

14. The hopper of claim 13 wherein the third wall second edge has a length which is greater than the length of the fourth wall second edge.

15. A hopper assembly comprising:

a hopper bin having a substantially trapezoidal discharge opening; and a charging adapter adjacent the discharge opening, the charging adapter having three walls, each having a portion which is substantially vertical relative to a horizontal plane, and a trough which connects at least two of the walls.

16. The hopper assembly of claim 15 wherein:

the first charging adapter wall has first and second ends, first and second edges, a first portion oriented in a first plane which is inclined at a first angle relative to the horizontal plane and a second portion which is substantially vertical relative to the horizontal plane;

the second charging adapter wall has first and second ends, first and second edges, a first portion oriented in a second plane which is inclined at a second angle relative to the horizontal plane and a second portion which is substantially vertical relative to the horizontal plane;

the third charging adapter wall connects the first and second charging adapter walls; and the trough connects the second portions of the first and second charging adapter walls whereby the first and second charging adapter wall first edges are at a first predetermined separation at the first ends and a second predetermined separation at the second ends and the first and second charging adapter wall second edges are at a third predetermined separation at the first ends and a fourth predetermined separation at the second ends.

17. The hopper assembly of claim 15 wherein the hopper bin comprises:

a) a receiving opening located at a predetermined distance from the discharge opening and has a given perimeter which is greater than the discharge opening perimeter;

b) a first hopper wall including:

i. first and second edges, ii. a first portion oriented in a first plane, and iii. a second portion oriented in a second plane which forms a greater angle relative to a horizontal plane than the first plane;

c) a second hopper wall including:

i. first and second edges, ii. a first portion oriented in a third plane, and iii. a second portion oriented in a fourth plane which forms a greater angle relative to the horizontal plane than the third plane;

d) a third hopper wall oriented in a fifth plane and including first and second edges; and e) a fourth hopper wall oriented in a sixth plane and including first and second edges, wherein the hopper walls are connected such that the receiving opening perimeter includes the first edges of the hopper walls, the discharge opening perimeter includes the second edges of the hopper walls and the discharge opening is generally trapezoidal.

18. The hopper assembly of claim 17 wherein:

the first charging adapter wall has first and second ends, first and second edges, a first portion oriented in a seventh plane which is inclined at a first angle relative to the horizontal plane and a second portion which is substantially vertical relative to the horizontal plane;

the second charging adapter wall has first and second ends, first and second edges, a first portion oriented in an eighth plane which is inclined at a second angle relative to the horizontal plane and a second portion which is substantially vertical relative to the horizontal plane;

the third charging adapter wall connects the first and second charging adapter walls; and the trough connects the second portions of the first and second charging adapter walls whereby the first and second charging adapter wall first edges are at a first predetermined separation at the first ends and a second predetermined separation at the second ends and the first and second charging adapter wall second edges are at a third predetermined separation at the first ends and a fourth predetermined separation at the second ends.

* * * * *